United States Patent [19]

Taylor

[11] Patent Number: 5,036,607

[45] Date of Patent: Aug. 6, 1991

[54] COMBINATION LIFT, SHOVEL AND BUCKET ATTACHMENT FOR VEHICLES

[76] Inventor: Carlos V. Taylor, 7982 S. 2175 East, Ogden, Utah 84403

[21] Appl. No.: 551,767

[22] Filed: Jul. 10, 1990

[51] Int. Cl.[5] ..... E02F 3/00

[52] U.S. Cl. ..... 37/118 A; 37/117.5

[58] Field of Search ..... 37/231, 234, 235, 236, 37/264, 118 A, DIG. 12, 117.5

[56] References Cited

U.S. PATENT DOCUMENTS

| | | | |
|---|---|---|---|
| 3,002,638 | 10/1961 | Needy | 37/264 |
| 3,350,797 | 11/1967 | Dassinger et al. . | |
| 3,431,662 | 3/1969 | Bles | 37/264 X |
| 3,432,949 | 3/1969 | Glesmann . | |
| 3,866,342 | 2/1975 | Cooper . | |
| 3,874,539 | 4/1975 | Staley . | |
| 3,908,849 | 9/1975 | Carroll . | |
| 3,987,562 | 10/1976 | Deen et al. . | |
| 4,187,624 | 2/1980 | Blau | 37/234 X |
| 4,222,186 | 9/1980 | Molby . | |
| 4,249,323 | 2/1981 | Mathis et al. | 37/236 X |
| 4,329,109 | 5/1982 | Bleyker . | |
| 4,333,250 | 6/1982 | Henderson . | |
| 4,342,377 | 8/1982 | Goodwin . | |
| 4,403,432 | 9/1983 | Biance . | |
| 4,520,903 | 6/1985 | Arnold et al. . | |
| 4,545,721 | 10/1985 | Pettersson | 37/117.5 X |
| 4,619,060 | 10/1986 | Knowlton | 37/231 |
| 4,680,880 | 7/1987 | Boneta . | |
| 4,754,562 | 7/1988 | McGarrah et al. . | |

*Primary Examiner*—Dennis L. Taylor
*Assistant Examiner*—J. Russell McBee
*Attorney, Agent, or Firm*—Trask, Britt & Rossa

[57] ABSTRACT

A lift shovel attachment adapted for detachable mounting on a vehicle is disclosed. The attachment includes a support adapted for detachable pivoted mounting on the undercarriage or frame of a vehicle. The support is mounted to a generally "U"-shaped support frame which includes a pair of spacedly mounted arms. A shovel having a bottom pair of spacedly mounted upstanding sidewalls and a laterally extending backwall is mounted in the frame by means of pivoted connections between each arm and a respective sidewall. The frame includes a laterally-extending shelf which extends beneath the shovel bottom and serves as a support therefor. A fluid pressure cylinder is mounted to the support and to the shovel backwall and is adapted to incline that shovel by pivoting the shovel about its respective pivot mountings on the frame.

15 Claims, 5 Drawing Sheets

COMBINATION LIFT, SHOVEL AND BUCKET ATTACHMENT FOR VEHICLES

BACKGROUND OF THE INVENTION

1. Field

This invention relates to attachments adapted for mounting on the front of vehicles. More particularly, the invention relates to a lift, shovel or bucket-type attachment structure adapted for such mounting.

2. Statement of the Art

Various quick-connect attachments have been suggested for affixing to vehicles for the purpose of improving or extending the utility of such vehicles. One of the most commonly known types of attachments is a snow plow blade. This type of attachment has been attached for years to the front of small trucks for use in plowing driveways, parking lots, and roads. A representative snow plow structure is shown in U.S. Pat. No. 4,680,880 (Boneta). The Boneta patent describes a generally curvilinear blade which is mounted to a undercarriage of a vehicle by means of a support assembly. The assembly includes a means of forcedly angling the blade. The blade is operated by means of a pneumatic cylinder.

Another example of a quick-connect snow plow attachment is shown in U.S. Pat. No. 3,987,562 (Deen et al.). The Deen et al. snow plow assembly includes a snow plow blade fitted with a pair of fluid pressure cylinders which are adapted to modify the angle of the blade relative to the vehicle. In this construction, the cylinders pivot the blade about a vertical axis. Various other attachment structures are shown in U.S. Pat. No. 3,432,949 (Glesmann); U.S. Pat. No. 3,866,342 (Cooper); U.S. Pat. No. 4,403,432 (Biance); U.S. Pat. No. 4,439,109 (Den Bleyker); U.S. Pat. No. 3,874,539 (Staley); U.S. Pat. No. 4,520,903 (Arnold et al.); U.S. Pat. No. 4,342,377 (Goodwin); U.S. Pat No. 3,908,849 (Carroll); U.S. Pat. No. 4,222,186 (Molby) and U.S. Pat. No. 4,333,250 (Henderson).

One of the principal advantages inherent in the use of quick-release snow plow blades adapted for use with lightweight domestic trucks, is the ability to perform light plowing without the need to resort to expensive industrial graders and plows. It follows that quick-release snow plow blades have found considerable use and application in light plowing activities such as driveway, parking lot and road snow plowing activities.

While many snow plow blade attachments have been suggested for mounting to a vehicle, few, if any attempts have been made to provide a lift shovel or bucket-type attachment vehicles which is adapted for use in transporting soil, gravel or similar material during warmer seasons such as spring, summer and fall.

Understandably, it would be beneficial to be able to use a lightweight vehicle as a lightweight earth or gravel transport. Alternatively, the use of such a vehicle as a lightweight lift truck also presents many advantages to the routineer. It is contemplated that such a combination lift shovel and bucket attachment would find considerable applications in construction and plant nursery environments where a considerable amount of earth, plants, and other semi-heavy loads must be transported, yet the transport tasks are not of sufficient weight to make the use of industrial-type graders and plows cost beneficial. While the attachments suggested in U.S. Pat. No. 4,222,186; U.S. Pat. No. 3,908,849; and U.S. Pat. No. 4,333,250 have suggested some types of lifting means, these structures appear to be adapted specifically for use with heavy-duty or industrial-type vehicles. These attachments do not appear of the type which are mountable on conventional domestic trucks or vehicles intended primarily for highway use.

There continues to be a need for a lift, shovel and bucket-type attachment which is releaseably and detachably mountable to a conventional pickup truck whereby the pickup truck may function as a small, effective lift shovel or bucket. Not only may the attachment be used for moving earth, gravel, any loose-type material and sundry other types of soil, but furthermore, the attachment may also be used to transport articles such as potted plants, trees, or bags of cement, fertilizer, wood chips, and other articles typically found in the plant nursery or construction environment.

SUMMARY OF THE INVENTION

A lift, shovel, bucket-type attachment of the instant invention includes a support, a frame, a shovel, and a fluid pressure cylinder. Hereinafter, the invention will be designated a "lift shovel" or "lift shovel attachment" for purposes of clarity.

The support is adapted for detachable mounting to a vehicle. In most instances, the support is adapted for pivoted mounting to the undercarriage of the vehicle. The frame includes two arms which are spacedly mounted from each other. The frame is fixedly mounted to the support. In most instances, the frame is configured so as to correspond to the exterior perimeter of the shovel substantially over the length of the frame member itself. The frame defines a laterally-extending, shelf-like flange which is adapted to extend beneath the shovel and serve as a support therefor. In some constructions, the frame assumes a substantially "U-shaped" configuration. Furthermore, the frame may also include a rigid, reinforced upstanding sidewall or support wall which is adapted to provide a support member for the upstanding portion of the shovel which is positioned adjacent the frame sidewalls. The frame sidewalls assist in resisting any lateral displacement of the shovel sidewall during the use or operation of the lift shovel itself.

The shovel is configured to form a bucket-like receptacle for objects such as dirt, sod, potted trees and plants, or other articles to be transported by the lift shovel. In one construction, the shovel includes a bottom, a pair of spacedly mounted sidewalls which are mounted on the bottom to extend upwardly, i.e., upstandingly from the bottom. A backwall is also mounted on the bottom to extend vertically upward therefrom. In preferred constructions, the sidewalls are each interconnected to the backwall to form a generally "U"-shaped upstanding wall construction.

Each sidewall has defines two opposing ends and furthermore defines a midpoint between those two ends. Each sidewall is pivotedly mounted to a respective arm of the frame. The two sidewall-frame arm mountings are oriented to be colinear, i.e. the pivot axis formed by the two mountings are colinear one with another. The shovel is pivotedly rotatable about the frame. In some constructions, each sidewall is mounted to a respective arm of the frame at a location between the free end and the midpoint of the respective sidewall In other constructions, the mounting of the sidewall to the arm of the frame is preferably accomplished at a location proximate the free end of the sidewall. A fluid pressure cylinder is mounted to the support on its first end and to the shovel on its opposing second end. The fluid pressure cylinder is adapted to rotate the shovel about its pivot mountings on the frame and thereby provide the user with the capability of inclining the shovel so as to dump articles, or dirt, whatever is loaded on the shovel out of the shovel. In some constructions, the fluid pressure cylinder is mounted to the backwall of the shovel at a location midway between the opposing ends of that backwall.

The shovel may further include a means of raising and lowering the shovel assembly vis-a-vis the vehicle on which the shovel is to be mounted. The lift means, which is mounted to the main structure of the lift shovel attachment, may include a hydraulic motor and an auxiliary support means, both adapted to be mounted on the vehicle, and a linkage means adapted for interconnecting the auxiliary support means and the lift shovel frame or support. The lift means is adapted for raising or lowering the lift shovel attachment by rotating that attachment about its pivoted mounting on the vehicle.

DETAILED DESCRIPTION OF THE DRAWINGS

Figure 6:
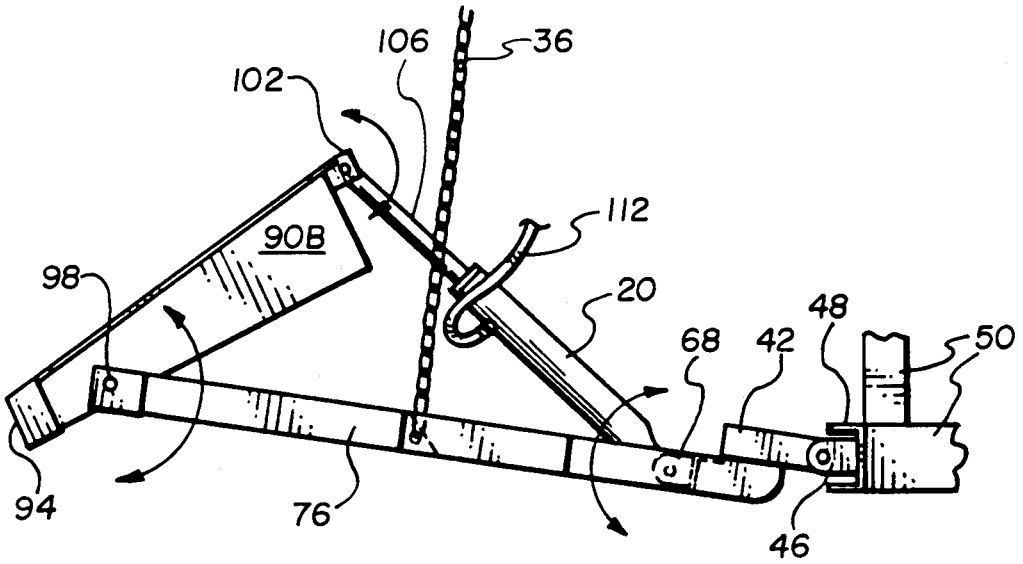
FIG. 6 is a side view of the lift shovel attachment of FIG. 3 showing the shovel in a raised or dumping orientation condition.

As shown in FIG. I, a vehicle, generally 10, is fitted on its frontmost portions with a lift shovel attachment of the invention. As shown, the lift shovel attachment includes a support 14, a frame 16, a shovel 18, and as shown more clearly in FIG. 3, a fluid pressure cylinder 20. The cylinder 20 is operable &:o incline the shovel 18 as shown in FIG. 6 in order to discharge from the shovel material and/or articles retained in the shovel. The lift shovel attachment 12 is mounted to an undercarriage frame structure 22 which is secured to the underframe of the vehicle 10. A lift means 24 is also mounted to the front of the vehicle and adapted to raise and lower the lift shovel attachment 12 by pivoting the attachment about its mounting on the undercarriage frame structure 22. The lift means 24 includes a hydraulic motor 26 is rigidly mounted to the bumper structure 28 of the vehicle The hydraulic motor is interconnected to a support frame 30 which includes a pair of support arms 32, which is pivotally mounted to a support arm 34. It is the support arm 34 which is directly mounted to the hydraulic motor 26. The support arm 34 is physically attached to a pair of vertically extending chain members 36. Chain members 36, as shown to advantage in FIG. 6, are mounted at their free ends to the frame 16 or the support 14.

The Support

Figure 3:
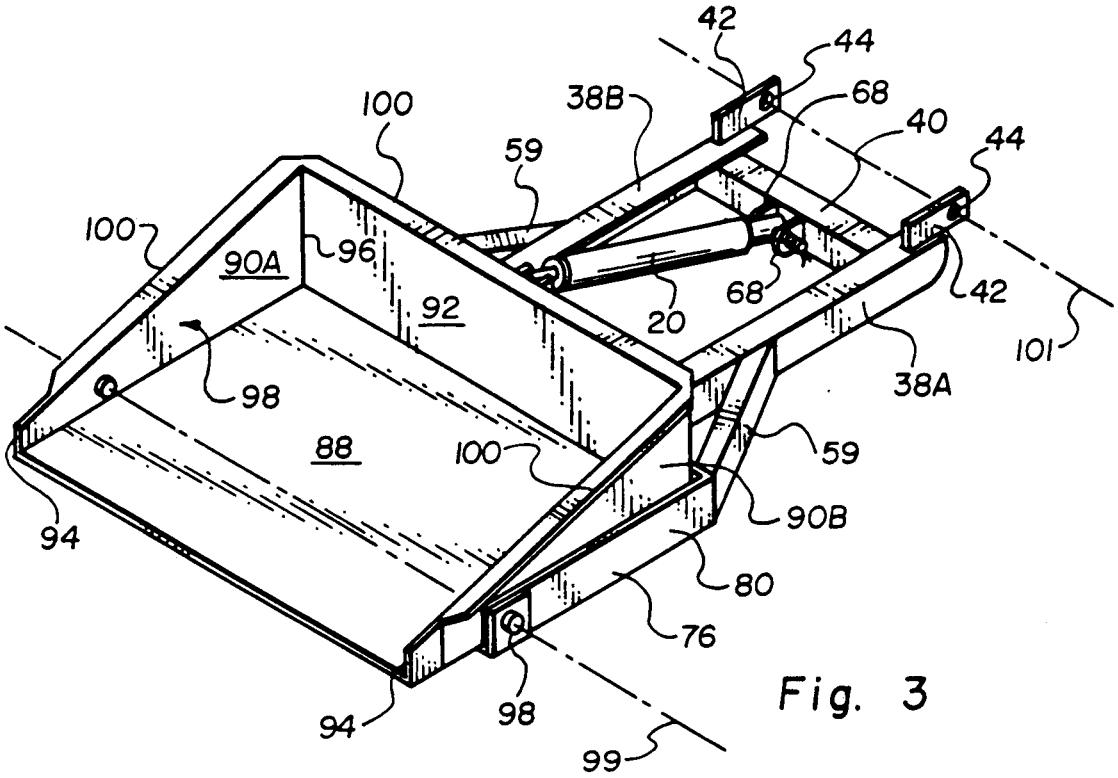
FIG. 3 is a perspective view of the lift shovel attachment.
Figure 4:
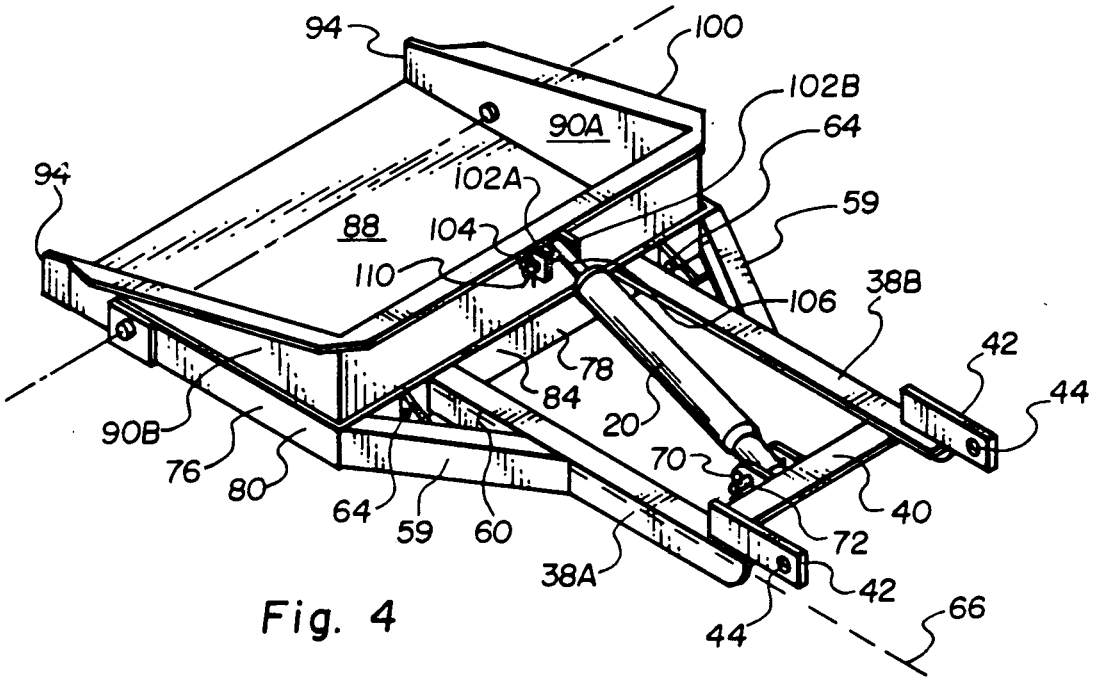
FIG. 4 is a rear perspective view of the lift shovel attachment.

As shown to advantage in FIGS. 3 and 4, the support 14 includes a pair of elongate, "L"-shaped support members which are positioned parallel and spacedly apart from one another. These support members identified generally as 38*a* and 38*b*, are interconnected one to another by a laterally extending support member 40. Each of the support members 38*a* 38*b* are fitted on their respective top surface, proximate the free end thereof, with a longitudinal extension 42 which forms an ear for each of the support member 38. The extension 42 defines an aperture 44 which extends through the thickness thereof. Each ear 42 is dimensioned to be received within a pair of spacedly-mounted, longitudinally-extending brackets 46 which are mounted to a support member 48. Support member 48 extends laterally along the vehicle's undercarriage and is mounted to an undercarriage support frame 50. The support frame 50 is mounted to the undercarriage or frame of the vehicle 10 and thereby forms a physical mounting for the attachment of the lift shovel attachment 12. A pin 52 extends through an opening 54 defined within a first bracket 46 and then extends through the aperture 44 in a respective ear 42. The pin 52 then extends through a corresponding registered opening 54 in the second bracket 46. Each pin 52 forms a pivot axis 101 for its respective ear 42. The axis 101 are colinear As shown, each pin 52 includes a generally circular ring 58 mounted therein. The rings 58 permit the user to grasp each ring 58 and exert a laterally-directed force to remove and otherwise disengage the pin 52 from its mounting in the apertures 54 and 44 and thereby disengage the ear 42 from its respective bracket mountings 46. This construction forms a quick release adapted to enhance the ease of detaching the attachment 12 from the vehicle I0.

The frame 14 includes two auxiliary support extensions 59. Each extension 59 is mounted to a respective support member 38 at an angulated orientation defined by the angle 60. A mounting bracket 62 is mounted to each respective auxiliary support member 59 to extend outwardly therefrom. Bracket 62 is positioned generally parallel to the longitudinal axis 66 of each support member 38. As shown to advantage in FIG. 4, each support bracket 62 defines an aperture 64 which extends through the thickness thereof.

Referring to FIGS. 3 and 4, the laterally extending support bracket 40 of the frame 12 also defines a pair of outwardly-extending support brackets 68. These support brackets are generally planar in configuration and are spacedly mounted apart from one another to define an opening therein dimensioned to receive one end of a fluid pressure cylinder 20. As shown to advantage in FIGS. 3 and 4, each of the brackets 68 defines an aperture therein dimensioned to receive a mounting pin 70 as shown to advantage in FIG. 4. Mounting pin 70 is retained in place by means of a cotter pin 72 which passes through an aperture formed in one end of the pin 70. The pin 70 forms a pivot mounting and also a pivot axis for pressure cylinder 20.

The Frame

Figure 7:
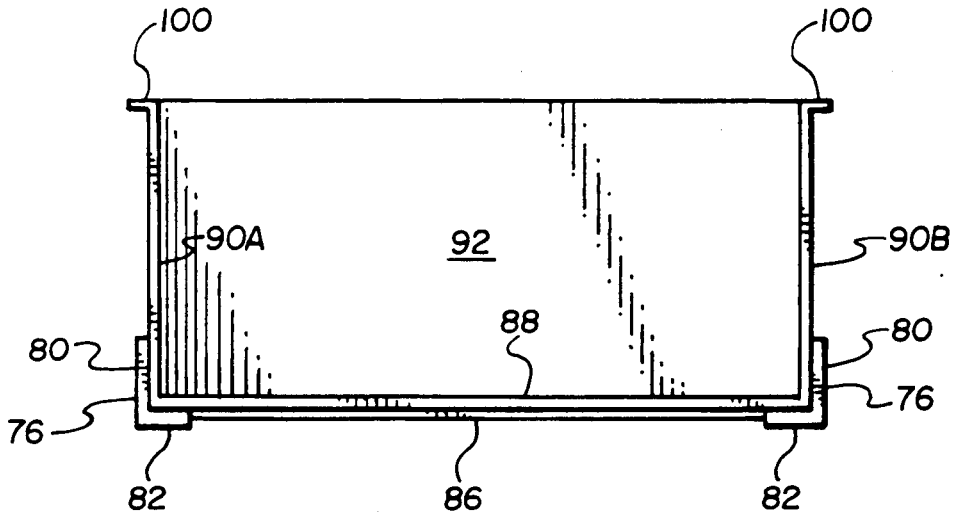
FIG. 7 is a cross-sectional view of the lift shovel attachment of FIG. 2 taken along section lines 7—7.

As shown in FIGS. 3, 4 and 7, the frame 16 includes a pair of arm-like members 76 which are parallely spacedly mounted, at their respective ends, to a laterally-extending member 78. Each of the arms 76, as shown in front view in FIG. 7, defines an upwardly extending sidewall or support wall 80 and a laterally-extending shelf or flange 82. The laterally-extending flange 82 extends laterally sufficiently to form a support shelf on which the shovel 18 is supported in the shovel's rest orientation. The vertically-extending sidewall 80 is configured and positioned to provide a vertical support wall for the shovel. The laterally-extending member 78 interconnects the two arms 76 and also provides a vertically-upstanding support wall 84 and a laterally-extending support shelf or flange 86. In the preferred construction, the frame 16 is formed as shown, i.e., in a generally "U"-shaped configuration which is configured and dimensioned to correspond to the exterior perimeter of the shovel 18. While the frame 16 is dimensioned to correspond to the shovel's perimeter, it is configured so as to provide a sufficient leeway for the shovel to pivot with respect to the frame 14. At the same time, the frame sidewalls 80 provide some degree of lateral support to the upstanding sidewalls and backwall of the shovel member itself. Furthermore, as previously discussed, the flange or shelf-like structure 82 of the arms and flange 86 of the backwall extend sufficiently outwardly from the upstanding sidewalls of the frame 14 to extend beneath the shovel and provide a support surface for the bottom of the shovel.

The Shovel

The shovel 18, as shown to advantage in FIG. 3, includes a bottom surface 88. Surface 88 is a planar, rectangular-shaped member, oriented generally horizontally. A pair of upstanding, generally planar sidewalls 90*a* and 90*b* and an upstanding backwall 92 are mounted on one edge of the bottom 88. The backwall 88 is positioned between the two upstanding sidewalls 90. Each of the sidewalls 90 includes a free end 94 and an end 96 which is mounted to the backwall 92. Each sidewall 90 also defines mid point which is defined as being mid way between the ends 94 and 96.

As shown in FIGS. 3 and 4, the frame 16 is mounted to the shovel 18 by means of a pair of pivot pins 100 Each pivot pin 100 extends through an opening in a respective arm 76 and is thereafter received through an opening defined within a respective sidewall 90.

As shown to advantage in FIG. 3, the mounting of the sidewall 90 to the arm 76 is accomplished at a location along the sidewall which is between the free end 94 of the sidewall and the midpoint 98 of the sidewall. In preferred constructions, the mounting of the sidewall 90 to its respective arm 76 is accomplished at a location which is proximate the free end 94. As shown, the mountings of the sidewalls to the respective arm 76 forms the pivot axis 98, which is generally parallel to the pivot axis 101 formed by the mounting of the ears 42 to the support frame 48.

A somewhat laterally-extending flange 100 is mounted atop shovel 18. The flange 100 is positioned on the uppermost surface of each of the sidewalls 90 and is also positioned to extend along the topmost surface of the backwall 92. As shown, each of the sidewalls 90 may adopt a generally triangular appearance.

As shown to advantage in FIG. 4, the rod end of the fluid cylinder 20 is mounted to the rear surface of the backwall 92 by means of a pair of spacedly mounted outwardly extending brackets 102 which are mounted to the rear surface of the backwall 92. This mounting is similar to the aforedescribed mounting of the opposing end of the fluid pressure cylinder 20. Each of the brackets 102 define an aperture therethrough dimensioned to receive a pin 104. The pin 104 extends through the aperture of the first bracket 102*a*, thereafter through an aperture defined within the rod 106 of fluid pressure cylinder 20 and is thereafter received through the opposing registered aperture in mounting bracket 102*b*. As shown, a respective cotter pin 110 is extended through an aperture formed within the pin 104 at each of its ends to retain the pin 104 in place and thereby provide a pivoted mounting for the rod 106.

The fluid pressure cylinder 20 may be of a conventional construction and may be either of a hydraulic or a pneumatic type. The cylinder 20 is connected by hydraulic conduit 112 to the hydraulic motor 26 which is mounted on the bumper 28 of the vehicle. The mounting of the conduit 112 is shown to advantage in FIGS. 5 and 6.

As shown in FIGS. 6–7, the cylinder 20 is adapted to exert a force against backwall 88 by outwardly displacing the rod 106 from the cylinder 20. Due to the orientation of the cylinder 20 and rod 106 vis-a-vis the shovel 18, the effect of that force application is the rotation of the shovel about its pivot axis 99 formed by pivot pins 98. The placement of the axis 99 toward the front open end of the shovel enhances the operation of the shovel.

Lift Means

Figure 1:
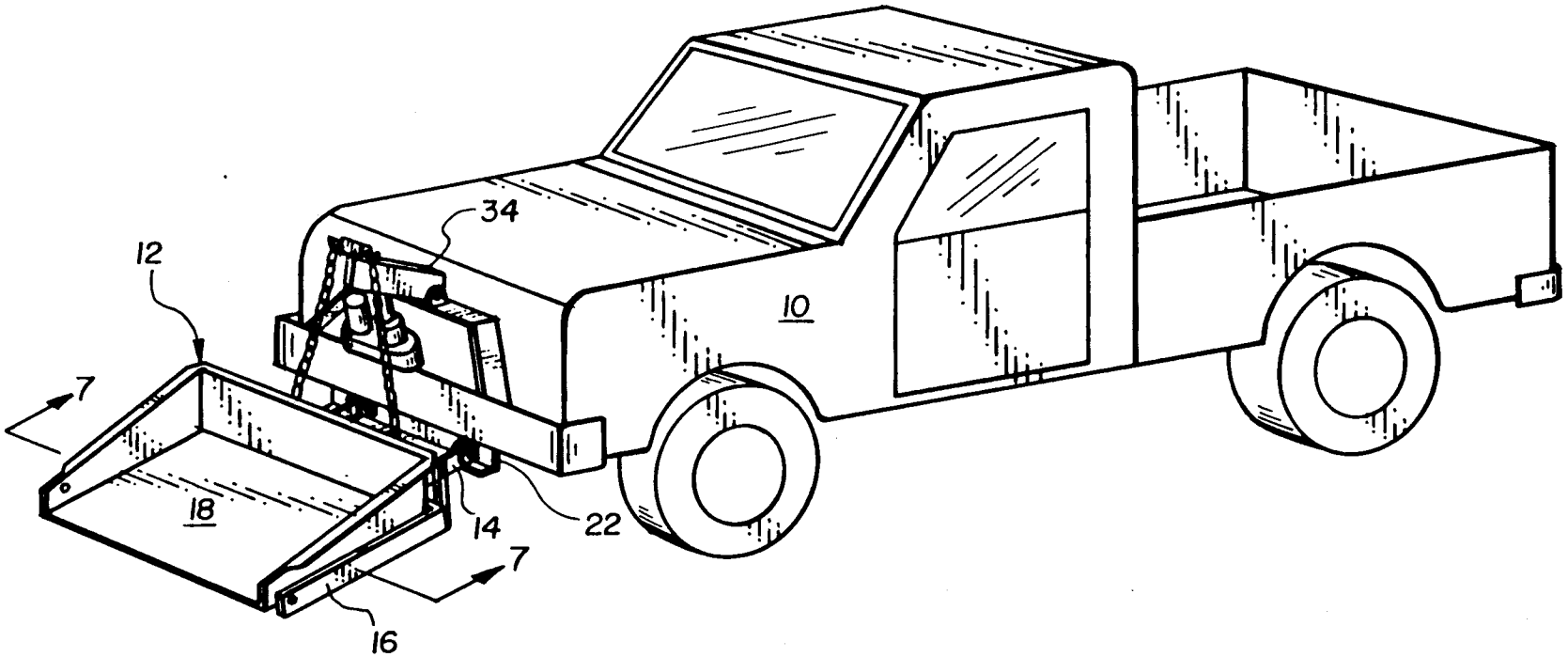
FIG. 1 is a perspective view of a vehicle fitted with the lift shovel attachment of the instant invention.
Figure 2:
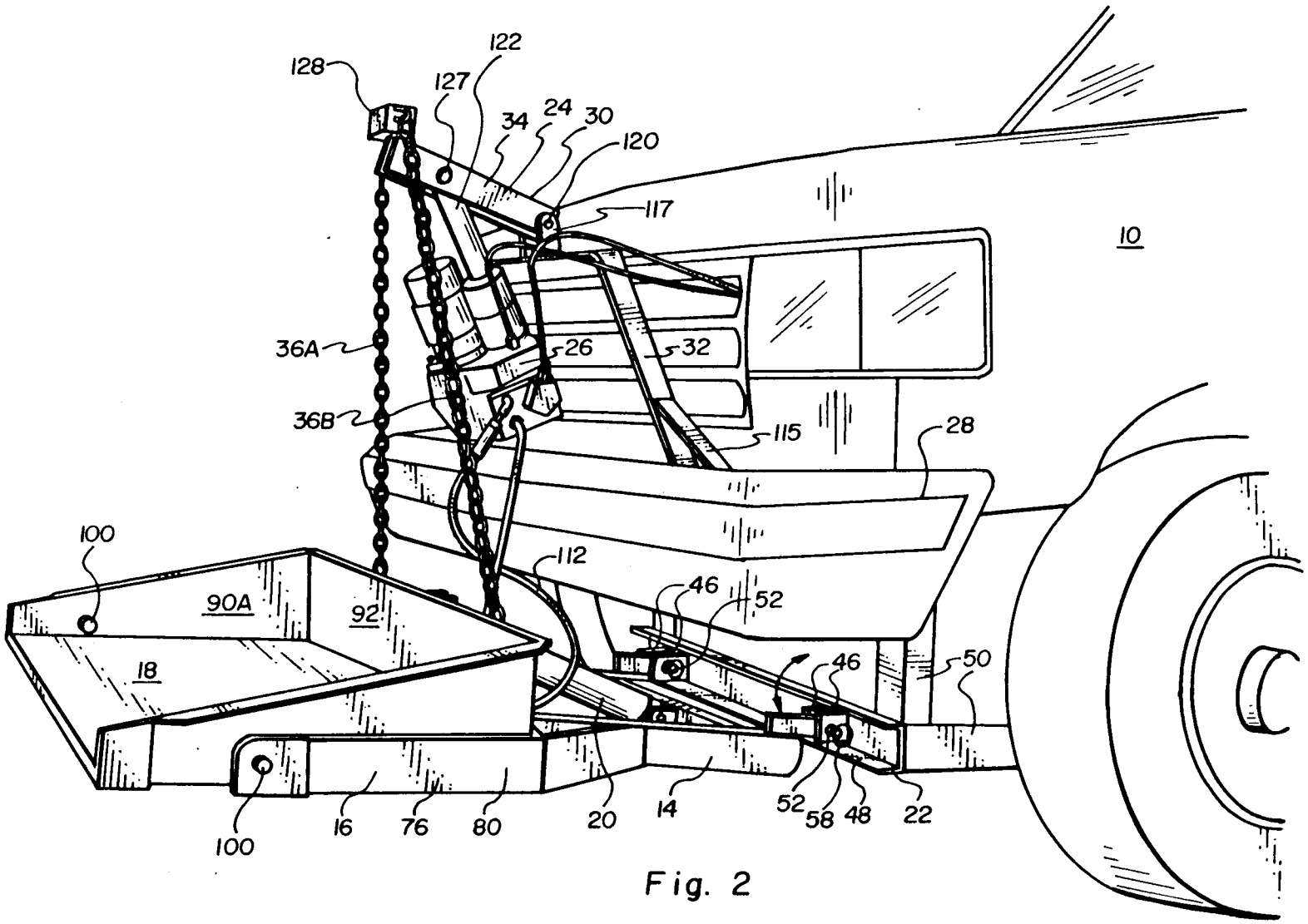
FIG. 2 is a perspective view of the front portion of the vehicle of FIG. I showing the mounting of the lift shovel attachment to the undercarriage of the vehicle.

As shown to advantage in FIGS. 1 and 2, a lift means 24 may include a hydraulic motor 26 having a conventional construction. Motors 26 of this type are oftentimes used in association with snow plows. A motor 26 is mounted on the bumper 28 of the vehicle, and is fixedly held thereon. A generally inverted "U"-shaped support 32 is mounted to the bumper assembly of the truck 10 and may also include a pair of angulated auxiliary support members. Extensions 115 provide further structural integrity to the support 32. Mounted atop the uppermost portion of the support 32 are two vertically-extending support brackets 117 which are spacedly mounted apart from one another. Each bracket 117 defines a hole therethrough, the holes are in register one with another and adapted to receive a pivot pin 120 which passes therethrough. The pin 120 also passes through the pair of support extensions 34 which are positioned between the two brackets 117. The support brackets 34 are each positioned on opposing sides of a rod 122 which extends outwardly from the motor 26. The rod 122 is pivotally mounted to the supports 34 by means of a pivot pin 127. Mounted on the end of the supports 34 is a support bracket 128 which is connected to two downwardly-extending chains 36*a* and 36*b*. These chains are mounted on their opposing ends to a respective mounting bracket 62 through the aperture 64 thereof previously described.

In operation, the hydraulic motor is adapted to extend a rod 122 either upwardly or downwardly, thereby pivoting the extension 34 about its pivot axis 120. As the support extension 34 is thus pivoted, the chains 36 are either raised or lowered, and thereby cause a corresponding raising or lowering of the frame 16 or support 14, this causes the rotation of the support 16 about its pivot axis defined by pin 46 as shown by arrow 130.

The disclosed invention provides several advantages over conventional constructions. Owing to the particular construction of the shovel 18, the lift shovel can operate equally as a scoop, a blade and a lift platform. The lift shovel can replace conventional trailers, garden carts, wheelbarrows, manual labor, shovels, fork lifts, blades, and tractor scoops in lightweight environments.

Figure 5:
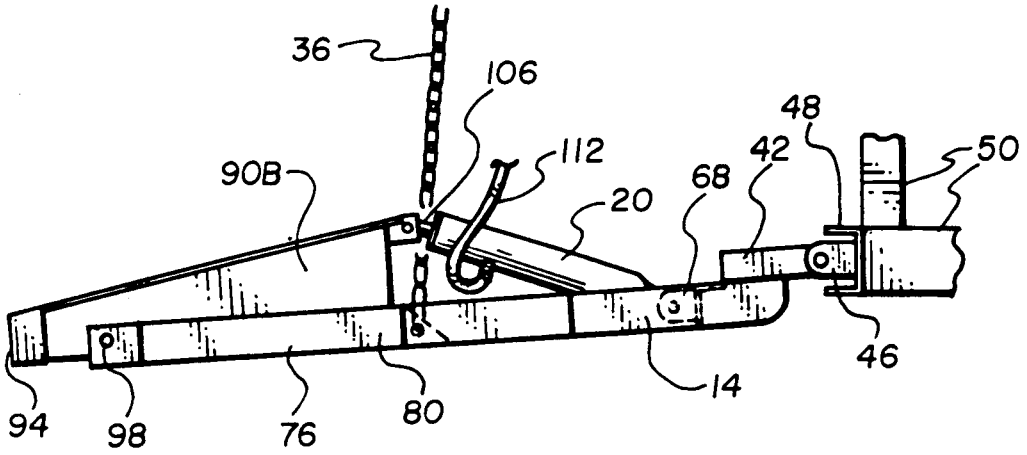
FIG. 5 is a side view of the lift shovel attachment of FIG. 3 showing the shovel is a rest orientation.

Owing to the particular placement of the cylinder 20 and the construction of the frame 16, the shovel 18 is in a stable rest or unpowered position in the orientation shown in FIG. 5. It follows that the user may scoop up material onto the shovel, operate the shovel as a blade, or insert the shovel under an article to be lifted without operating the cylinder 20. The cylinder 20 only needs be operated when dumping the material or article off of the shovel 18.

The placement of the pivot point 98 proximate the open end of the shovel 18, increases the stability of the shovel 18 during use in that any resistant force applied to the shovel has a minimal effective moment arm about the pivot point 98. It is observable that for a given incline of the bottom shovel surface 88 to the horizon, that for a given force application to the open end 94 of the shovel 18, the dimensional length of the effective moment arm increases as the pivot point is moved from the location shown in FIG. 3–4 back toward the shovel backwall 88. Understandably, with an increase in effective moment arm, the size of the resistive moment which must be provided by the cylinder 20 is increased. Applicant's structure, in providing for the placement of the pivot point 98 between the open end 94 and the mid point 98 of the sidewall, minimizes the quantity of resistive moment that must be supplied by the cylinder 20. Applicant's system effectively provides an optimal system by minimizing the requisite force applications by the cylinder 20.

Reference herein to details of the illustrated embodiments is not intended to limit the scope of the appended claims which themselves recite the features regarded as important to the invention.

What is claimed is:

1. A lift shovel attachment for use on a vehicle, said lift shovel attachment comprising:

a support adapted for pivoted mounting to a vehicle;

a frame mounted on said support, said frame having a laterally extending shelf-like flange;

a shovel, pivotedly mounted to said frame, said shovel being positioned on top of said shelf-like flange and being supported thereon;

a fluid cylinder mounted on said support, said shovel being adapted for rotating said shovel about its pivoted mounting on said frame.

2. The lift shovel attachment of claim 1 wherein said frame is configured to conform to an exterior perimeter of said shovel.

3. The lift shovel attachment of claim 2 wherein said frame has an upstanding sidewall adapted to form a vertically extending support wall for said shovel.

4. The lift shovel attachment of claim 1, wherein said shovel includes a bottom, a pair of sidewalls spacedly mounted upstandingly on said bottom, and a backwall upstandingly mounted on said bottom, wherein said fluid cylinder is mounted to said backwall midway between the opposing ends thereof.

5. The lift shovel attachment of claim 1 further including a lift means connected thereto adapted for mounting on said vehicle, said lift means being adapted for vertically raising and lowering said shovel by pivoting said support about its mounting on said vehicle.

6. A lift shovel attachment for use on a vehicle, said lift shovel attachment comprising:

a support adapted for pivoted mounting to a vehicle;

a substantially "U"-shaped frame having a pair of spacedly mounted arms, said "U"-shaped frame being mounted on said support;

a shovel having a bottom, a pair of upstanding sidewalls spacedly mounted on said bottom, and a backwall mounted upstandingly on said bottom, each of said sidewalls defining a pair of opposing ends and a midpoint between said ends, each of said sidewalls being pivotedly mounted to a respective frame arm at a location between said mid-point and a said end; and a fluid cylinder pivotedly mounted to said support and to said backwall, said fluid cylinder being adapted to rotate said shovel about said mountings of said shovel sidewalls with said frame arms.

7. The lift shovel attachment of claim 6 wherein said backwall defines two opposing ends, said fluid cylinder being mounted to said backwall at a location midway between said opposing ends.

8. The lift shovel attachment of claim 6 wherein said "U"-shaped frame conforms to the exterior perimeter of said shovel over the length of said "U"-shaped frame.

9. The lift shovel attachment of claim 6 wherein said shovel is mounted to said "U"-shaped frame proximate the open front of said shovel.

10. The lift shovel attachment of claim 6 wherein said "U"-shaped frame includes a laterally extending shelf configured to extend beneath and to support said shovel.

11. The lift shovel attachment of claim 6 wherein said support is fitted with quick release connection means for connecting said lift shovel to said vehicle.

12. The lift shovel attachment of claim 6 further including a lift means connected thereto adapted for mounting on said vehicle, said lift means being adapted for vertically raising and lowering said shovel by pivoting said support about its mounting on said vehicle.

13. The lift shovel attachment of claim 12 wherein said lift means comprises:

a hydraulic motor adapted for mounting on said vehicle;

an auxiliary support frame pivotedly mounted on said vehicle and connected to said hydraulic motor;

a linkage mounted on said auxiliary support frame on its first end and mounted on said support on its second end;

wherein said hydraulic motor is operable to pivot said auxiliary support frame, thereby pivoting said support about is pivoted mounting on said vehicle.

14. A lift shovel attachment for use on a vehicle, said lift shovel attachment comprising:

a dual leg support adapted for pivoted mounting to a vehicle;

a substantially "U"-shaped frame having a pair of spacedly mounted arms, said "U"-shaped frame having a laterally extending, self-like flange, said "U"-shaped frame being mounted on said dual leg support;

a shovel having a bottom, a pair of sidewalls upstandingly mounted on said bottom, and a backwall upstandingly mounted on said bottom, each said sidewall having a free end and a midpoint, each said sidewall being pivotedly mounted to a respective said arm at a location between said free end and said midpoint; and a fluid cylinder pivotedly mounted to said support and to said backwall, said fluid cylinder being adapted to rotate said shovel about said shovel sidewall mountings to said "U"-shaped frame;

wherein said "U"-shaped frame is configured to conform to the exterior perimeter of said shovel over the length of said "U"-shaped frame and wherein said shovel rests atop and is supported by said laterally extending, shelf-like flange of said "U"-shaped frame.

15. The lift shovel attachment of claim 14 wherein said fluid cylinder is mounted to said backwall midway between the opposing ends of said backwall.

* * * * *

UNITED STATES PATENT AND TRADEMARK OFFICE

CERTIFICATE OF CORRECTION

PATENT NO. : 5,036,607

DATED : Aug. 6, 1991

INVENTOR(S) : Carlos V. Taylor

It is certified that error appears in the above-identified patent and that said Letters Patent is hereby corrected as shown below:

ON THE TITLE PAGE,

Under Inventor, change zip code "84403" to --84405--.

In column 1, line 21 change "a" to --an--.

In column 1, line 43, delete ",".

In column 2, lines 60-61, change "colinear" to --collinear--.

In column 2, line 65, after "sidewall", insert therefore --.--.

In column 3, line 49, change "&:o" to --to--.

In column 3, line 60, after "vehicle" insert therfore --.--.

In column 4, line 9, after "38a" insert therefore --and--.

In column 4, line 28, change "axis" to --axes--; change "colinear" to --collinear--; after "collinear" insert therefore --.--.

In column 4, line 36, change "I0" to --10--.

In column 5, line 36, change "mid point" to --midpoint--.

In column 5, line 37, change "mid way" to --midway--.

In column 5, line 39, after "100" insert therefore --.--.

In column 6, line 44, change "!17" to --117--.

In column 6, line 60, after "14" insert therefore --.--; change "this" to --This--.

In column 7, line 24, change "mid point" to --midpoint--.

In column 7, line 43, change "shovel" to --fluid cylinder--.

In column 7, line 10, after "98" insert therefore --,--.

In column 8, line 7, change "mid-point" to --midpoint--.

In column 8, line 22, change "the" to --an--.

UNITED STATES PATENT AND TRADEMARK OFFICE

CERTIFICATE OF CORRECTION

PATENT NO. : 5,036,607

DATED : Aug. 6, 1991

INVENTOR(S) : Carlos V. Taylor

It is certified that error appears in the above-identified patent and that said Letters Patent is hereby corrected as shown below:

In column 8, line 46, change "is" to --its--.

Signed and Sealed this

Twenty-first Day of September, 1993

Bruce Lehman

*Attest:*

BRUCE LEHMAN

*Attesting Officer*

*Commissioner of Patents and Trademarks*